US005408711A

United States Patent [19]

McClelland

[11] Patent Number: 5,408,711

[45] Date of Patent: Apr. 25, 1995

[54] AIR MATTRESS ASSEMBLY

[76] Inventor: Marion McClelland, P.O. Box 1213, Center, Tex. 75935-1213

[21] Appl. No.: 243,787

[22] Filed: May 17, 1994

[51] Int. Cl.[6] ..... A47C 21/04; A47C 27/00

[52] U.S. Cl. ..... 5/461; 5/423; 5/468; 5/653; 297/452.47

[58] Field of Search ..... 5/284, 423, 461, 468, 5/653; 297/180.1, 452.45, 452.47

[56] References Cited

U.S. PATENT DOCUMENTS

| | | | |
|---|---|---|---|
| 1,007,028 | 10/1911 | Gilbert | 5/468 |
| 1,517,617 | 12/1924 | Cleveland | 5/468 |
| 2,807,033 | 9/1957 | Austen | 5/461 |
| 3,266,064 | 8/1966 | Figman | 5/284 X |
| 3,381,999 | 5/1968 | Steere, Jr. | 5/468 X |
| 3,503,308 | 4/1970 | Fenton | 297/452.47 |
| 3,770,318 | 11/1973 | Fenton | 5/468 X |
| 3,784,994 | 1/1974 | Kery | 5/348 |
| 3,822,425 | 7/1974 | Scales | 5/348 R |
| 3,942,202 | 3/1976 | Chevrolet | 5/348 R |
| 4,005,236 | 1/1977 | Graebe | 428/72 |
| 4,057,861 | 11/1977 | Howarth | 5/365 |
| 4,120,061 | 10/1978 | Clark | 5/350 |
| 4,536,906 | 8/1985 | Varndell et al. | 5/468 |
| 4,580,301 | 4/1986 | Ludman | 5/464 |
| 4,866,800 | 9/1989 | Bedford | 5/468 |
| 4,924,542 | 5/1990 | Yamaguchi | 5/481 |
| 4,980,940 | 1/1991 | Isshiki | 5/468 |

*Primary Examiner*—Michael F. Trettel
*Attorney, Agent, or Firm*—Harrison & Egbert

[57] ABSTRACT

An air mattress for preventing bedridden patients' suffering from bed sores and the like is provided. A mattress assembly is provided comprising a matrix member disposed throughout its interior region for uniformly distributing air to the mattress-patient interface. This matrix member comprises a network of vertical rigid tubes and interconnected horizontal rigid tubes which are configured to uniformly distribute air to the upper mattress surface. Ambient air enters into the bottom end of this plurality of vertical tubes and is then delivered to the upper mattress surface through a plurality of tufted recess surfaces located at the top end of the plurality of vertical tubes. The matrix member is contained within an air mattress portion which is, in turn, configured to be abuttably received by a corresponding peripheral mattress portion. The air mattress portion is secured to the peripheral mattress portion by brace members. This combination of air mattress and peripheral mattress portions rests upon a like sized frame member, at a predetermined height. Maintained by a plurality of spacers, this gap enables air to flow up through and among the array of tubes that populate the matrix member. Also provided is an air cushion assembly comprising an air cushion member having a matrix member and an outer air permeable covering for preventing chafing and sores to a seated person.

17 Claims, 4 Drawing Sheets

AIR MATTRESS ASSEMBLY

BACKGROUND OF THE INVENTION

This invention relates to mattresses and seat cushions, and more particularly relates to means for incorporating air into mattresses and seat cushions, for comfortably supporting a patient and the like, and thereby preventing bed sores and like maladies attributable to insufficient air circulation at the epidermal skin layer.

It is well known in the prior art that bedridden patients, particularly if their repose position is not regularly changed, tend to suffer from bed sores and the like.

It is also well known in the art that truck-drivers and the like, particularly if such driving is conducted frequently over long distances, tend to suffer posteriorly from skin irritation and the like.

There have been many attempts in the art to remedy or at least ameliorate bedridden patients' discomfort by using air mattresses. Such mattresses typically include, of course, one or more flexible enclosures which are filled with air. For example, In U.S. Pat. No. 4,057,861, Howorth discloses an open-cell mattress which delivers conditioned air through a diffusion mechanism. Scales discloses, in U.S. Pat. No. 3,822,425, an air mattress consisting of a plurality of vertically disposed cells which are constructed from a material which is permeable to gas but impermeable to both liquids and solids. The scales mattress limits passage therethrough to air, thereby preventing clogging from dirt and the like. Similarly, Ludman et al., in U.S. Pat. No. 4,580,301, disclose a mattress with a body of open-cell foam having air passages extending vertically therethrough.

In U.S. Pat. No. 4,005,236, Graebe teaches an expendable multi-celled mattress which is formed from spaced-apart vertical fluted cells located upon mandrels. This cell-fluting is configured to provide intercellular contact when the cells are inflated, thereby forming a continuous surface. Yamaguchi, in U.S. Pat. No. 4,924,542, teaches a sleeping mattress which purports to simulate pressure on acupuncture points. A mattress core member having a plurality of reinforcing concave regions with a plurality of surface semi-spherical members, is interposed between upper and lower cushion members. The upper cushion member includes a plurality of undulated projections having a plurality of holes therethrough, which are configured to receive the corresponding plurality of semi-spherical members.

There have been air mattresses disclosed in the prior art which use pressurized air to reach patients in repose and the like. For example, Clark, in U.S. Pat. No. 4,120,061 discloses a pneumatic mattress with flexible valved cylinders disposed side by side. These cylinders consist of upper and lower sections which are interconnected by a corrugated section, which, in turn, receives air at the bottom of its lower section. Similarly, in U.S. Pat. No. 4,542,547, Sato also teaches a pneumatic mattress comprising a plurality of bellows-shaped units which may be selectively inflated or deflated to alter repose position thereon. Kerry, in U.S. Pat. No. 3,784,994, also teaches an air mattress having vertically aligned inflatable bellows. Air is distributed through each bellows with a compressor. In U.S. Pat. No. 3,942,202, Chevrolet discloses an air support mattress having an array of passages adapted to receive pressurized air which is released at the mattress surface through an array of corresponding vents.

There have also been attempts in the prior art to promote comfort while sitting. For example, Weber, in U.S. Pat. No. 4,164,798, teaches a seat cushion for preventing excessive pressure on the coccyx.

While, as hereinbefore exemplified, practitioners in the art have attempted to improve the means for delivering air to the surface of a mattress, and to avoid clogging of air passages inhibiting such delivery, there has been less effort expended to assure that air is delivered uniformly thereat, without requiring pneumatics and the like. There has also been minimal effort expended to provide similar features to truck-drivers and the like who regularly sit for prolonged periods of time.

Accordingly, these limitations and disadvantages of the prior art are overcome with the present invention, and improved means and techniques are provided which are useful for inexpensively and conveniently delivering air uniformly to the mattress surface, for preventing bed sores and the like.

SUMMARY OF THE INVENTION

The present invention provides an improved air mattress for preventing bedridden patients' suffering from bed sores and the like. Thus, the present invention provides a mattress assembly comprising a matrix member disposed throughout its interior region for uniformly distributing air to the mattress-patient interface. As will be described in detail, it is a feature and advantage of the preferred embodiment that the matrix member comprises a network of vertical rigid tubes and interconnected horizontal rigid tubes which are configured to uniformly distribute air to the upper mattress surface. Preferably ambient air enters into the bottom end of this plurality of vertical tubes and is then delivered to the upper mattress surface through a plurality of tufted recesses located at the top end of the plurality of vertical tubes.

In accordance with the present invention, the matrix member is contained within an air mattress portion which is, in turn, configured to be abuttably received by a corresponding peripheral mattress portion. The air mattress portion is secured to the peripheral mattress portion by brace members. This combination of air mattress and peripheral mattress portions rests upon a like sized frame member, at a predetermined height. Maintained by a plurality of spacers, this gap enables air to flow up through and among the array of tubes that populate the matrix member.

Accordingly, means are provided to enable air to be uniformly delivered to the upper surface of a mattress without requiring pneumatic equipment or the like.

As should be appreciated by those skilled in the art, uniform delivery of air to the mattress-patient interface prevents bed sore and the like for bedridden patients. Similarly, uniform delivery of air to the interface between a truck-driver's posterior and his seat promotes comfort and also prevents the formation of sores and the like.

It is an object of the present invention to provide a means for preventing bed sores and the like, for bedridden patients.

It is also an object of the present invention to provide a convenient and inexpensive apparatus for promoting comfort to bedridden patients and for preventing sores and the like.

It is a further object of the present invention to provide an apparatus for providing a convenient and inexpensive apparatus for promoting comfort to truck-drivers and the like and for preventing sores and the like during prolonged driving patterns.

It is a specific object of the present invention to provide a mattress assembly comprising: a peripheral mattress portion configured to removably receive an air mattress portion; a first frame member disposed peripherally of said peripheral mattress portion, for supporting said peripheral mattress portion; said air mattress portion comprising: a matrix member having a plurality of interconnected of tubes disposed throughout interior of said air mattress portion, for communicating air to a plurality of tufted recess surfaces; said matrix member disposed in a perpendicular relationship with longitudinal axis of said peripheral matrix portion and comprising a plurality of vertical rigid cylindrical tubes configured to fixedly receive a plurality of horizontal rigid cylindrical tubes; each of said plurality of vertical rigid cylindrical tubes having one of said plurality of tufted recess surfaces disposed at the upper end thereof, such that said plurality of tufted recess surfaces are further disposed in a coplanar relation with each other and configured to comfortably support a patient disposed in a reclining position; a second frame member disposed peripherally of said air mattress portion, for supporting said air mattress portion in said peripheral mattress portion; a first plurality of brace members for attaching said matrix member to said second frame member; a second plurality of brace members for attaching said second frame member to said first frame member; a base mattress portion disposed beneath said peripheral mattress portion for supporting said peripheral mattress portion and said air mattress portion; and a plurality of spacer members disposed between said base mattress portion and said peripheral mattress portion, for maintaining a spaced-apart relationship therebetween, to allow air to flow from the bottom end of said plurality of vertical rigid cylindrical tubes upwardly therethrough and simultaneously sidewardly through said plurality of horizontal rigid cylindrical tubes, to deliver said air to said plurality of tufted recess surfaces and, in turn, to said patient.

These and other objects and features of the present invention will become apparent from the following detailed description, wherein reference is made to the figures in the accompanying drawings.

IN THE DRAWINGS

DETAILED DESCRIPTION

Figure 1:
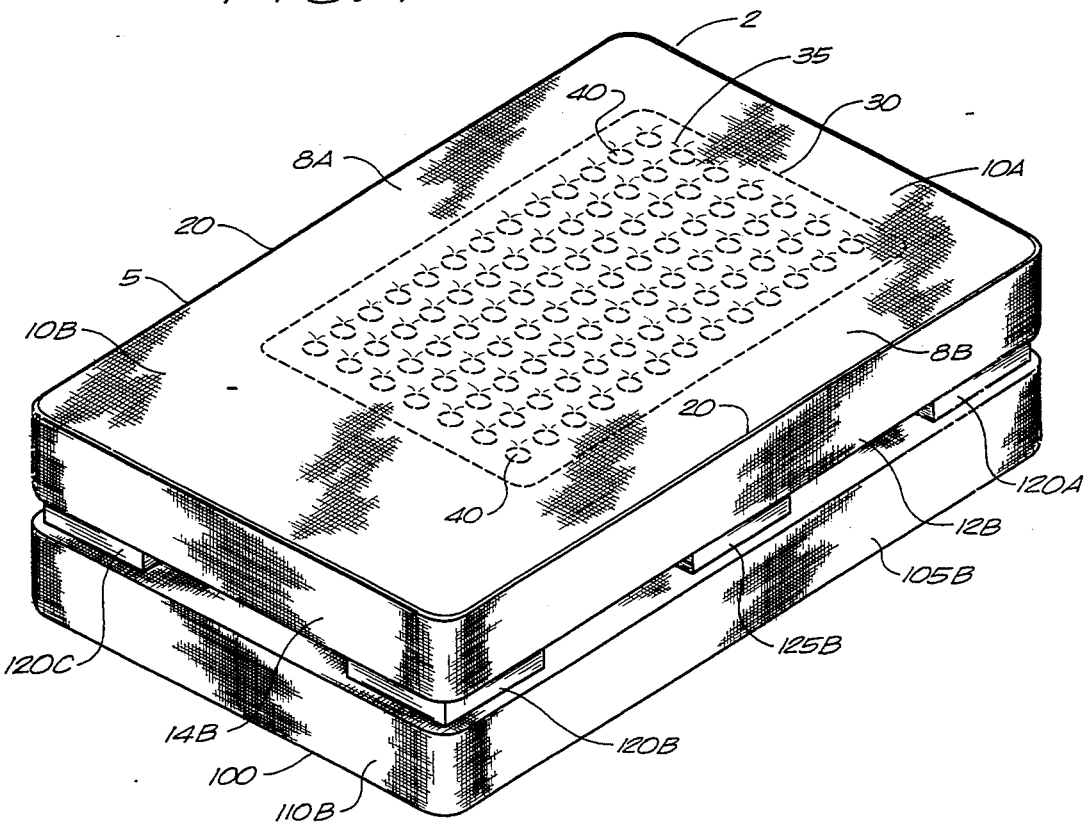
FIG. 1 depicts a frontal perspective view of an assembly embodying the present invention.

Now referring to FIG. 1, there is depicted a frontal perspective view of preferred embodiment of mattress assembly 2 configured in accordance with the present invention. More particularly, there is shown housing peripheral mattress portion 5 contained fixedly within frame member 20. As will become clear to those skilled in the art, peripheral mattress portion 5 is constructed from a conventional mattress but with preferably rectangular cut-out area 25 configured to abuttably receive air mattress portion 30, as will be hereinafter described in detail.

Still referring to FIG. 1, frame member 20 of peripheral mattress portion 5 supports longitudinal top surfaces 8 A–B and lateral top surfaces 10 A–B, respectively. Also shown are longitudinal exterior walls 14 A–B and lateral exterior walls 16 A–B respectively. As will be hereinafter described in detail, air mattress portion 30 comprises matrix member 35 shown with plurality of tufted surface recesses 40. Peripheral mattress portion 5 is depicted resting upon spacer members 120 A–D and 125 A–B, which, in turn, is disposed upon base mattress portion 100. More particularly, a space-apart relationship is maintained between peripheral mattress portion 30 and base mattress portion 100 by corner spacer members 120 A–D and medial spacer members 125 A–B. As will become evident to those skilled in the art, this spaced-apart relationship between peripheral mattress portion 5 and base mattress portion 100 allows air to flow from the bottom of air mattress portion 30 through a plurality of tubes contained within matrix member 35 to plurality of tufted surface recesses 40 disposed at the top of air mattress portion 30.

Figure 3:
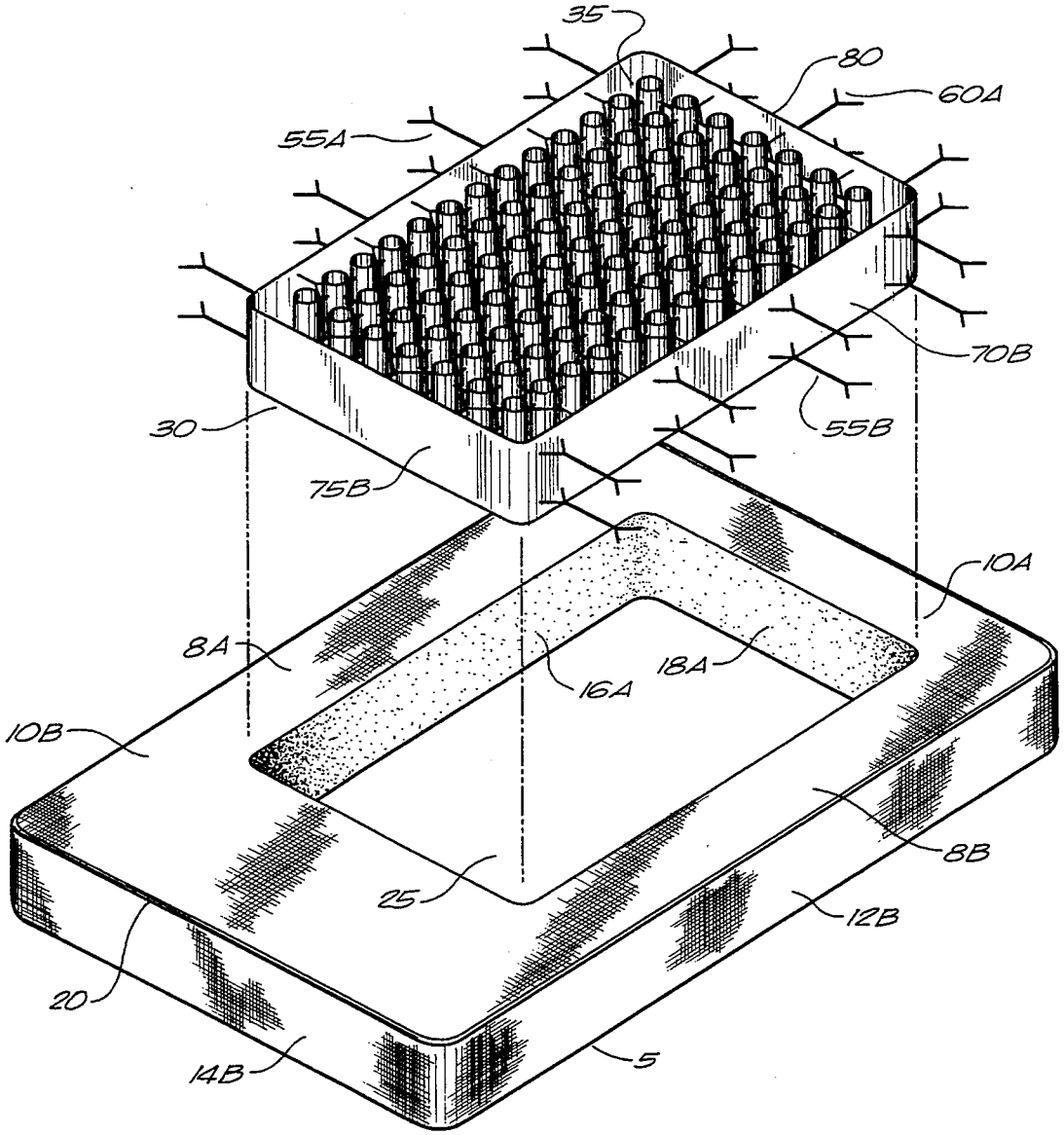
FIG. 3 depicts a frontal perspective view of the assembly depicted in FIG. 1, prior to the assembly of its air mattress portion into its peripheral mattress portion.

Now referring to FIG. 3, there is depicted the relationship between peripheral mattress portion 5 and air mattress portion 30. Peripheral mattress portion 5 is configured with rectangular cut-out area 25 for abuttably receiving like-sized rectangular air mattress portion 30. In particular, exterior longitudinal walls 70 A–B of air mattress portion 30 are abuttably received by interior longitudinal walls 16 A–B, respectively, of peripheral mattress portion 5. Similarly, exterior lateral walls 75 A–B of air mattress portion 30 are abuttably received by interior lateral walls 18 A–B, respectively, of peripheral mattress portion 5. Air mattress portion 30 is secured to peripheral mattress portion by plurality of longitudinal brace members 55 A–B and by plurality of lateral brace members 60 A–B. Thus, in accordance with the present invention, plurality of brace members 55B firmly attach or bite into each of exterior wall 70B of air mattress portion 30 and interior wall 16B (not shown) of peripheral mattress portion 5.

Similarly, plurality of brace members 55A firmly attach or bite into each of exterior wall 70A (not shown) of air mattress portion 30 and interior wall 16A of peripheral mattress portion 5. Plurality of brace members 60A firmly bite into each of exterior wall 75B of air mattress portion 30 and interior wall 18B (not shown) of peripheral mattress portion 5. Similarly, plurality of brace members 60A firmly bite into each of exterior wall 75A (not shown) of air mattress portion 30 and interior wall 18A of peripheral mattress portion 5. It should be apparent to those skilled in the art that there are available a diversity of brace means for securing together mattress portions as contemplated in the present invention. What is required is a means for maintaining the medial position of air mattress portion 30 relative to peripheral mattress portion 5 while mattress assembly embodiments 2 support a patient and the like thereon.

Figure 4:
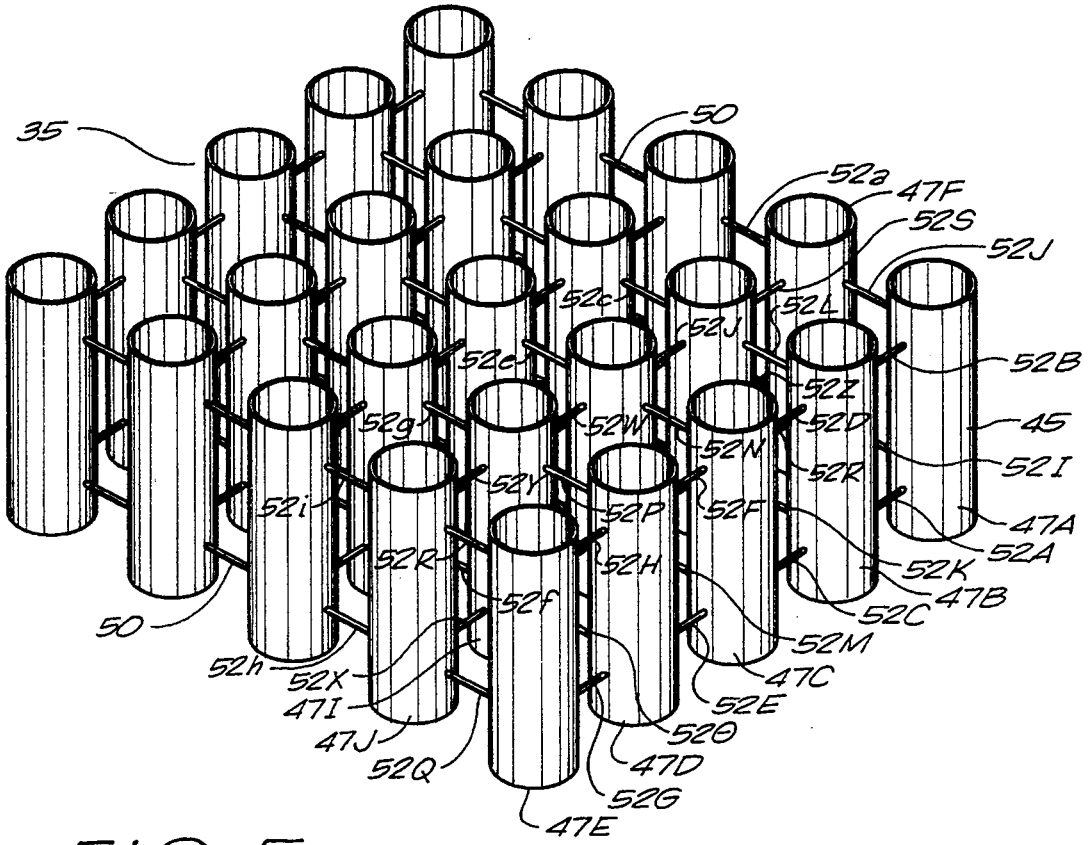
FIG. 4 depicts an isolated frontal view of an embodiment of a portion of the assembly depicted in FIGS. 1–3.

As will become clear to those skilled in the art, the present invention provides a simple apparatus for delivering air to the contact surface of a mattress, whereby a patient or other bed-ridden individuals may rest or recuperate without suffering from bedsores and the like caused by a lack of air being circulated to the interface of the upper surface of a mattress and such patent or individual's skin or clothing. Now referring to FIGS. 4 and 5, the advantageous air delivery engendered by the present invention may be observed. First referring specifically to FIG. 4, there is shown matrix member 35 preferably comprising plurality of vertical tubes 45 fixedly interconnected with plurality of horizontal tubes 50. In accordance with the preferred embodiment of the present invention, both plurality of vertical rigid tubes 45 and plurality of horizontal rigid tubes 50 are configured with a cylindrical cross-section. As shown in FIG. 4, it is advantageous for each tube 47 of plurality of vertical tubes 45 to be constructed with a diameter larger than the diameter of each tube 52 of plurality of vertical tubes 50. This, of course, primarily promotes the flow of air in an upward direction toward the patient.

Still referring to FIG. 4, matrix member 35 is depicted comprising corner vertical tube 47A is fixedly interconnected with two adjacent vertical tubes 47B–F. More particularly, vertical tube 47A is interconnected with vertical tube 47B via upper horizontal tube 52B and lower horizontal tube 52A; vertical tube 47A is interconnected with vertical tube 47F via upper horizontal tube 52J and lower horizontal tube 52I. Similarly, corner vertical tube 47E is fixedly interconnected with two adjacent vertical tubes 47D–J. More particularly, vertical tube 47E is interconnected with vertical tube 47D via upper horizontal tube 52H and lower horizontal tube 52G; vertical tube 47E is interconnected with vertical tube 47J via upper horizontal tube 52R and lower horizontal tube 52Q.

It is further seen that vertical tube 47D is interconnected with vertical tube 47C via upper horizontal tube 52F and lower horizontal tube 52E; vertical tube 47D is interconnected with vertical tube 47I via upper horizontal tube 52P and lower horizontal tube 520. Similarly, vertical tube 47D is interconnected with vertical tube 471 via upper horizontal tube 52P and lower horizontal tube 52O; vertical tube 47B is interconnected with vertical tube 47G via upper horizontal tube 52L and lower horizontal tube 52K.

Figure 5:
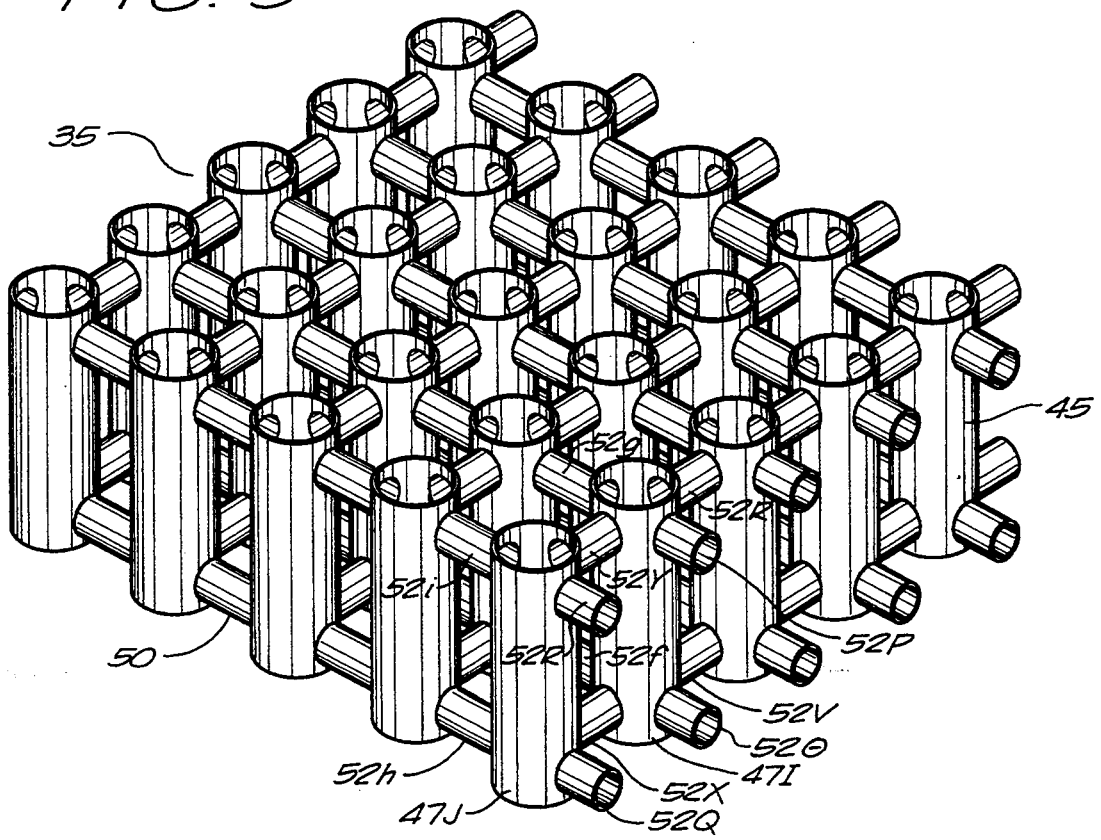
FIG. 5 depicts an isolated frontal view of another embodiment of a portion of the assembly depicted in FIGS. 1–3.

Now referring specifically to FIG. 5, there is shown another embodiment of matrix member 35 preferably comprising plurality of vertical tubes 45 fixedly interconnected with plurality of horizontal tubes 50. For example, just like the embodiment depicted in FIG. 4, vertical tube 47J is fixedly interconnected with vertical tube 47I via upper horizontal tube 52Y and lower horizontal tube 52X; vertical tube 47J is interconnected with vertical tube 47E (not shown) via upper horizontal tube 52R and lower horizontal tube 52Q. It should be clear to those skilled in the art that the plurality of horizontal tubes depicted in FIG. 5 comprises tubes with a significantly larger cylindrical cross-section than the cross-section of the horizontal tubes comprising the comparable plurality of horizontal tubes depicted in FIG. 4. Indeed, there is a greater disparity between the respective diameters of interconnecting vertical and horizontal tubes in the matrix member embodiment depicted in FIG. 4 than in the matrix member embodiment depicted in FIG. 5. In accordance with the teachings of the present invention, the preferred embodiment depicted in FIG. 5, for example, could be constructed with vertical tubes having a diameter nominally twice the diameter of the horizontal tubes. On the other hand, the embodiment depicted in FIG. 4, could be constructed with a vertical to horizontal tube diameter ratio of as much as ten to one, under appropriate air flow conditions, to achieve advantageous distribution of the air to the plurality of tufted recess surfaces.

The configuration of interconnected cylindrical tubes depicted in FIG. 5 tends to promote distribution of air flow longitudinally across mattress assembly 2. On the other hand, the configuration of interconnected cylindrical tubes depicted in FIG. 4 tends to promote distribution of air flow vertically and mitigate air flow longitudinally across mattress assembly 2. Depending upon ambient room conditions and whether or not there exists a forced flow of air using conventional devices, either of these embodiments accomplish the teachings of the present invention. Indeed, any similar arrangement of interconnected horizontal and vertical rigid tubes can form a matrix member capable of achieving the purposes of the present invention.

Figure 2:
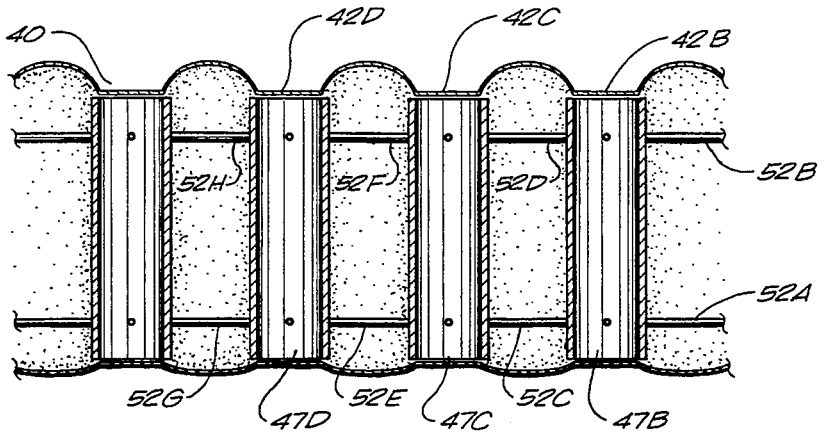
FIG. 2 depicts a cross sectional view of a portion of the assembly depicted in FIG. 1.

Referring now to FIG. 2, there is depicted a cross-sectional view through matrix member 35, cut along the midpoint of a row of vertical tubes depicted in FIGS. 1, 3 and 4. Thus, again, vertical tube 47C is shown fixedly interconnected with neighboring vertical tubes 47D and 47B via horizontal upper tubes 52F and 52D, respectively, and via horizontal lower tubes 52E and 52C, respectively. The plurality of preferably rigid horizontal and vertical tubes is shown entrenched in conventional mattress padding or filler 95. Also shown is plurality of tufted recess surfaces 40. In particular, tufted recess surface 42D is clearly shown disposed immediately above vertical tube 47D. Tufted recess surface 42C is shown disposed immediately above vertical tube 47C and tufted recess surface 42B is shown disposed immediately above vertical tube 47B.

Thus, in accordance with the present invention, an assembly is provided for effectively and conveniently delivering air to the upper surface of a mattress to, in turn, provide adequate ventilation and the like to a patent reclining thereon. Under the concept of the present invention, troublesome bedsores and the like may be prevented or at least minimized because of the manner in which the present invention tends to bathe a patient in flowing air.

Figure 6:
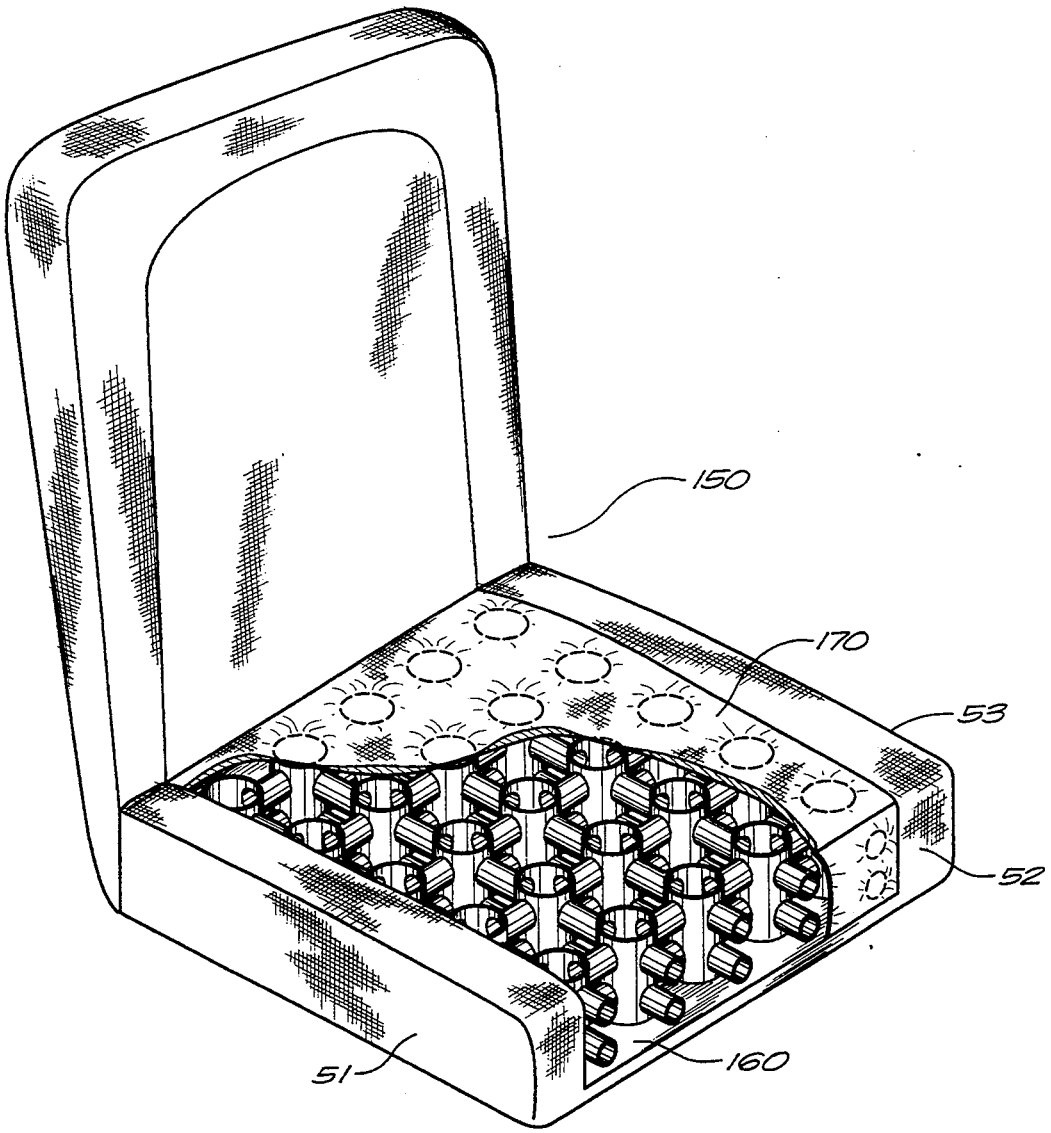
FIG. 6 depicts a frontal perspective view of another assembly embodying the present invention.

As is known to those skilled in the art, drivers of vehicles such as tracks and taxi cabs also suffer from sores and the like because of lack of air being regularly supplied to their posterior, particularly during prolonged contact with seats. FIG. 6 depicts a partial cutaway frontal perspective view of an embodiment of the present invention constructed for use as a seat cushion in trucks, taxi cabs, etc. More particularly, there is shown cushion assembly 150 with matrix member 160 comprising plurality of vertical and horizontal rigid cylindrical tubes as has hereinbefore been described in detail. Also shown is plurality of tufted recess surfaces 170 which, of course, provides a comfortable interface for a truck or taxi cab driver or the like.

Embodiments of the present invention designed for seat cushions and the like, of course, are more space-limited than mattresses. Accordingly, the matrix member taught by the present invention may be disposed within a seat in a manner analogous to the hereinbefore described mattress configuration, or the matrix member may be directly attached to the walls of a truck cushion and the like. Similarly, air flow may be introduced into the matrix member from three open sides thereof preferably through an air permeable covering well known in the art. As depicted in FIG. 6 air preferably enters matrix member 160 through air permeable outer covering material S1, S2 and S3, and this air reaches a seated person, thereby enhancing comfort and reducing chafing, sores, etc.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the concept of the present invention is to measured by the scope of the appended claims herein.

What is claimed is:

1. A mattress assembly comprising:

a peripheral mattress portion configured to removably receive an air mattress portion;

a first frame member disposed peripherally of said peripheral mattress portion, for supporting said peripheral mattress portion;

said air mattress portion comprising:

a matrix member disposed throughout interior of said air mattress portion, for communicating air to a plurality of tufted recess surfaces;

said matrix member disposed in a perpendicular relationship with a longitudinal axis of said peripheral mattress portion and comprising a plurality of vertical rigid tubes configured to fixedly receive a plurality of horizontal rigid tubes;

each of said plurality of vertical rigid tubes having one of said plurality of tufted recess surfaces disposed at the upper end thereof, such that said plurality of tufted recess surfaces are further disposed in a coplanar relation with each other and configured to comfortably support a patient disposed in a reclining position;

a second frame member disposed peripherally of said air mattress portion, for supporting said air mattress portion in said peripheral mattress portion;

a first plurality of brace members for attaching said matrix member to said second frame member;

a second plurality of brace members for attaching said second frame member to said first frame member;

a base mattress portion disposed beneath said peripheral mattress portion for supporting said peripheral mattress portion and said air mattress portion; and a plurality of spacer members disposed between said base mattress portion and said peripheral mattress portion, for maintaining a spaced-apart relationship therebetween, to allow air to flow from the bottom end of said plurality of vertical rigid tubes upwardly therethrough and simultaneously sidewardly through said plurality of horizontal rigid tubes, to deliver said air to said plurality of tufted recess surfaces and, in turn, to said patient.

2. The mattress assembly recited in claim 1, wherein each of said plurality of vertical rigid tubes are disposed perpendicularly of each of said plurality of rigid horizontal tubes.

3. The mattress assembly recited in claim 1, wherein each of said plurality of vertical rigid tubes are congruent to each other.

4. The mattress assembly recited in claim 1, wherein each of said plurality of horizontal rigid tubes are congruent to each other.

5. The mattress assembly recited in claim 1, wherein each of said plurality of vertical rigid tubes are at least twice the diameter of each of said plurality of rigid horizontal tubes.

6. The mattress assembly recited in claim 1, wherein each of said plurality of spacer members are fixedly attached to said base mattress portion.

7. A seat cushion assembly comprising:

a peripheral cushion portion configured to removably receive an air cushion portion;

a first frame member disposed peripherally of said peripheral cushion portion, for supporting said peripheral cushion portion;

said air cushion portion comprising:

a matrix member disposed throughout interior of said air cushion portion, for communicating air to a plurality of tufted recess surfaces;

said matrix member disposed in a perpendicular relationship with a longitudinal axis of said peripheral cushion portion and comprising a plurality of vertical rigid tubes configured to fixedly receive a plurality of horizontal rigid tubes;

each of said plurality of vertical rigid tubes having one of said plurality of tufted recess surfaces disposed at the upper end thereof, such that said plurality of tufted recess surfaces are further disposed in a coplanar relation with each other and configured to comfortably support a seated person;

a second frame member disposed peripherally of said air cushion portion, for supporting said air cushion portion in said peripheral cushion portion;

a first plurality of brace members for attaching said matrix member to said second frame member;

a second plurality of brace members for attaching said second frame member to said first frame member;

a base cushion portion disposed beneath said peripheral cushion portion for supporting said peripheral cushion portion and said air cushion portion; and a plurality of spacer members disposed between said base cushion portion and said peripheral cushion portion, for maintaining a spaced-apart relationship therebetween, to allow air to flow from the bottom end of said plurality of vertical rigid tubes upwardly therethrough and simultaneously sidewardly through said plurality of horizontal rigid tubes, to deliver said air to said plurality of tufted recess surfaces and, in turn, to said seated person.

8. The seat cushion recited in claim 7, wherein each of said plurality of vertical rigid tubes are disposed perpendicularly of each of said plurality of rigid horizontal tubes.

9. The seat cushion assembly recited in claim 7, wherein each of said plurality of vertical rigid tubes are congruent to each other.

10. The seat cushion assembly recited in claim 7, wherein each of said plurality of horizontal rigid tubes are congruent to each other.

11. The seat cushion assembly recited in claim 7, wherein each of said plurality of vertical rigid tubes are at least twice the diameter of each of said plurality of rigid horizontal tubes.

12. A seat cushion assembly comprising:

an air cushion member having a matrix member disposed throughout interior of said air cushion member, for communicating air to a plurality of tufted recess surfaces;

said matrix member disposed in a perpendicular relationship with a longitudinal axis of said air cushion member and comprising a plurality of vertical rigid tubes configured to fixedly receive a plurality of horizontal rigid tubes;

each of said plurality of vertical rigid tubes having one of said plurality of tufted recess surfaces disposed at the upper end thereof, such that said plurality of tufted recess surfaces are further disposed in a coplanar relation with each other and configured to comfortably support a seated person;

a plurality of brace members for attaching said matrix member to said air cushion member; and an outer coveting means disposed peripherally of said air cushion member, to allow air to flow from the bottom end of said plurality of vertical rigid tubes upwardly therethrough and simultaneously to flow sidewardly from each lateral end of said plurality of horizontal rigid tubes, to deliver said air to said plurality of tufted recess surfaces and, in turn, to said seated person.

13. The seat cushion recited in claim 12, wherein each of said plurality of vertical rigid tubes are disposed perpendicularly of each of said plurality of rigid horizontal tubes.

14. The seat cushion assembly recited in claim 12, wherein each of said plurality of vertical rigid tubes are congruent to each other.

15. The seat cushion assembly recited in claim 12, wherein each of said plurality of horizontal rigid tubes are congruent to each other.

16. The seat cushion assembly recited in claim 12, wherein each of said plurality of vertical rigid tubes are at least twice the diameter of each of said plurality of rigid horizontal tubes.

17. The seat cushion assembly recited in claim 12, wherein said outer coveting member is permeable to air.

* * * * *